US005815966A

United States Patent [19]

Vestevich

[11] Patent Number: 5,815,966

[45] Date of Patent: Oct. 6, 1998

[54] PORTABLE ROOFTOP SIGN

[76] Inventor: Jacqueline K. Vestevich, 4751 Sandpiper La., West Bloomfield, Mich. 48323

[21] Appl. No.: 834,152

[22] Filed: Apr. 14, 1997

Related U.S. Application Data

[63] Continuation-in-part of Ser. No. 452,897, May 30, 1995, abandoned.

[51] Int. Cl.[6] ..... G09F 21/06

[52] U.S. Cl. ..... 40/217; 40/610

[58] Field of Search ..... 40/217, 602, 603, 40/604, 610, 560, 591, 592, 612; 52/38, 63, 105, 173.1, 173.3, 222; 135/125, 127, 141, 142; 116/63 P; 248/346.2, 910

[56] References Cited

U.S. PATENT DOCUMENTS

| | | | |
|---|---|---|---|
| 1,335,854 | 4/1920 | O'Callahan | 40/603 X |
| 1,539,376 | 5/1925 | Sweeney . | |
| 1,796,233 | 3/1931 | Barns | 40/217 |
| 1,847,739 | 3/1932 | Wilhelm | 40/217 |
| 1,866,199 | 7/1932 | Edwards | 40/217 |
| 1,933,878 | 11/1933 | Stebbins | 40/217 |
| 1,937,374 | 11/1933 | Wolff | 40/217 |
| 2,345,377 | 3/1944 | Bowen | 135/125 |
| 2,517,696 | 8/1950 | Bausch | 40/560 |
| 3,059,657 | 10/1962 | Turner | 135/118 X |
| 3,089,268 | 5/1963 | Frey | 40/604 |
| 3,102,365 | 9/1963 | Whitesell . | |
| 3,330,247 | 7/1967 | Gunderson | 40/612 X |
| 4,019,271 | 4/1977 | Latimer | 40/602 X |
| 4,261,417 | 4/1981 | Tingley | 52/173.1 X |
| 4,375,134 | 3/1983 | Sheetz | 40/610 X |
| 4,700,655 | 10/1987 | Kirby | 40/610 X |
| 4,817,319 | 4/1989 | Yitale | 40/603 X |
| 4,866,866 | 9/1989 | Rotter et al. | 40/610 |
| 5,240,058 | 8/1993 | Ward | 52/63 X |
| 5,345,961 | 9/1994 | Yercha et al. | 135/900 X |
| 5,359,796 | 11/1994 | Werling | 40/592 X |

*Primary Examiner*—Brian K. Green
*Attorney, Agent, or Firm*—Rader, Fishman & Grauer PLLC

[57] ABSTRACT

A portable rooftop sign includes a large flexible mesh sheet having a plurality of characters or logos disposed on an upper surface. A plurality of sleeves are attached to a lower surface of the sheet. The sign is installed on a generally planar roof of a building near an airport. Elongated weights or rods are slidably inserted into each of the sleeves to secure the flexible sheet to the roof. Each of the elongated weights comprises a plurality of rod sections which are removably connected by threaded ends. Portable light sources on the roof illuminate the sign at night or in low visibility. In colder climates, electric heating elements embedded in the sheet prevent snow and ice accumulation by melting the snow and ice, which then drains through the mesh sheet and is removed by the normal drainage of the roof.

16 Claims, 1 Drawing Sheet

PORTABLE ROOFTOP SIGN

This application is a continuation-in-part of application Ser, No. 08/452,897 filed on May 30, 1995, now abandoned.

BACKGROUND OF THE INVENTION

The present invention relates to a portable rooftop sign which is visible from aircraft.

Advertisers have attempted to cash in on the increasing number of people travelling around and through major airports. Billboards line the highways around the airport and indoor advertising signs abound within the airport buildings themselves. With the tremendous amount of competition in the outdoor advertising arena, advertising agencies and companies have expanded the media into new innovative forums, including advertising signs on airport baggage carousels, signs inset into grocery store floor tiles and on grocery conveyor belts and even a proposed orbiting environmental billboard, an inflatable advertising sign the size of more than 100 football fields, that will orbit the earth.

Because of urban growth and increased aircraft traffic, area airports have attempted to reduce noise-related complaints from local residents by altering flight paths to pass over non-residential areas. As a result, most landings and take-offs are concentrated over a limited area. Further, the vast majority of flights take place during daylight hours, specifically between 9:00 a.m. and 9:00 p.m.

A known airway sign, disclosed in U.S. Pat. No. 1,866,199, utilizes large rigid characters supported above the ground by framework consisting of a series of posts and horizontal brackets and rails. This sign includes many large, rigid heavy parts and is therefore not conveniently portable. Further, because the posts must be bolted down, the sign is not suitable for temporary use on a rooftop.

Another airway sign, disclosed in U.S. Pat. No. 1,937,374, includes a large mat comprising a plurality of substantially vertically arranged cells which provide a light absorbing surface. Letters, numerals or other indicating means formed of sheet metal are placed on the mat. The letters are provided with a plurality of bosses which ensure that the letters will be reflective when viewed from various angles. However the mat is not portable. The mat is a permanent structure; it is even contemplated that it could be used as a landing surface for aircraft.

An aviation marker disclosed in U.S. Pat. No. 1,847,739 provides individual characters or arrows each formed as a large permanent structure. Each character is formed of a plurality of parallel vertical plates intersected by a transverse row of vertical plates. The plates are suspended above a bottom surface to provide for the free discharge of water and snow. A plurality of lights on the bottom surface illuminate the plates to provide the appearance of a solid character when viewed at an angle. Each of these characters is a large heavy structure which would not be portable but would be permanently constructed on its intended location. These structures are not suitable for temporary or portable use on rooftops.

An aeronautical roof sign disclosed in U.S. Pat. No. 1,933,878 provides a permanent rooftop sign visible from aircraft. Characters are formed on a rooftop using gravel, crushed rock or slate of a color contrasting with those used to form the background. In this way, the sign or symbol is formed in the normal operation of building up a roof. Obviously this rooftop sign is not portable and the design cannot be changed without replacing the roof.

SUMMARY OF THE INVENTION

The present invention provides a portable rooftop sign including a large flexible mesh sheet having indicia such as characters and/or logos on its upper surface. The sign is installed on the roof of a building near the flight path of landing or departing aircraft to provide advertising messages which are visible to arriving and departing passengers.

In one embodiment, the sheet includes a plurality of parallel sleeves formed on its lower surface. Elongated weights are inserted into the sleeves to secure the sign to the top of an industrial building roof. The elongated weights each comprise a plurality of rod sections, which can be threadably joined or removably joined by other suitable means. In windier climates, additional weights can be detachably secured to the protruding ends of the elongated weights. Light sources on the roof illuminate the sign at night and at times of low visibility. In areas where snowfall is expected, electric heating elements can be embedded in the sheet to melt the snow.

The right to use building roofs can be negotiated with the building owners who, in exchange for monthly fees based on income from advertisers, will grant an easement for access to install, maintain and remove signs. Because the sign is portable, the sign can be removed from the roof after a negotiated term of advertisement or moved to another building. Because the sign is secured by weights, there is no damage to the roof from bolts or posts. Further, the mesh material of the flexible sheet ensures that the sign will not interfere with the drainage of water from the roof.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE INVENTION

Figure 1:
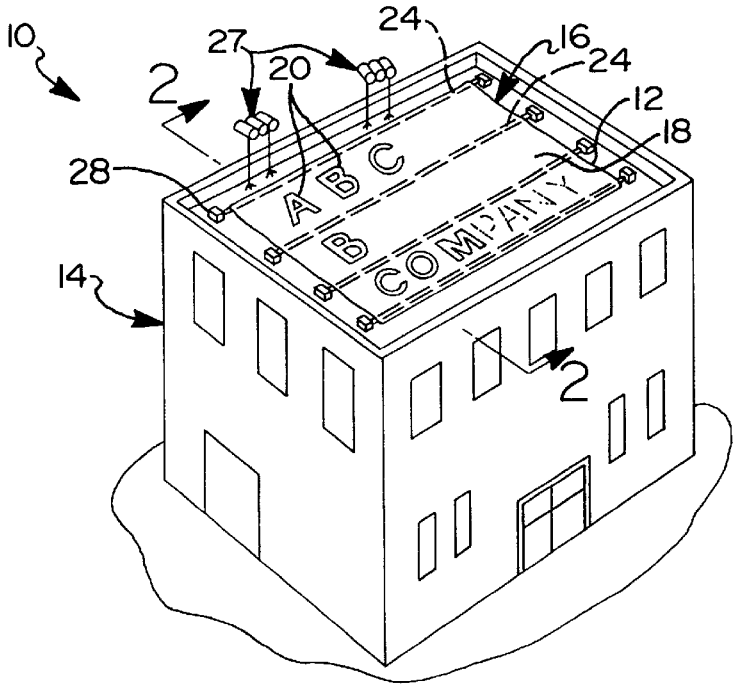
FIG. 1 is a perspective view of the portable rooftop sign installed on the roof of a building.

Referring to FIG. 1, a portable rooftop sign 10 in accordance with the present invention is shown installed on a generally horizontal planar roof 12 of a building 14. The building 14 is preferably for commercial or industrial use and is preferably located near an airport in the designated flight paths for airplane take-offs or landings. Although flight paths of each airport vary, it is anticipated that buildings within five miles of the runways of the airport will provide a suitable location.

The sign 10 includes a large, flexible sheet 16 which is preferably nylon or plastic mesh material. The sheet can be rectangular or can have a communicative shape such as a silhouette, logo or character. Vinyl coated mesh is a commercially available suitable material which includes a polyester, nylon or other plastic which is coated with vinyl for wear and weather resistance. The sheet 16 is preferably at least 40 feet by at least 60 feet. The sheet 16 includes an upper surface 18 having indicia 20 dyed, silk-screened or painted onto the sheet. Alternatively, indicia made of nylon or plastic mesh formed in the shape of characters or logos can be sewn, fixed by adhesive or removably secured to the sheet 16. The color of the indicia 20 should be selected to provide high contrast with the color of the sheet 16. In order to be clearly visible from the air, the indicia 20 should be very large, preferably at least twelve feet high.

Figure 6:
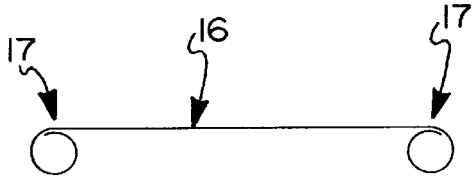
FIG. 6 is an alternate embodiment of the flexible steel sheet wherein the sleeves are formed by looping portions of the sheet.

The sheet 16 has a lower surface (not shown) opposite the upper surface 18. A series of generally parallel sleeves 24 (shown in phantom) are formed in the lower surface and extend completely across the sheet 16. The sleeves 24 can be sewn, fixed by adhesive, or otherwise attached to or made part of the sheet 16. Sleeves 24 can also be formed by looping sheet 16 as shown in FIG. 6 and sewing the loops along their respective seam lines 17. The portable rooftop sign 10 preferably includes a plurality of portable light sources 27 for illuminating the indicia 20 on the sheet 16 at night or in low visibility. The portable rooftop sign 10 may include optional end weights 28, if necessary, to secure the sheet 16 to the roof 12 in windier climates.

Figure 2:
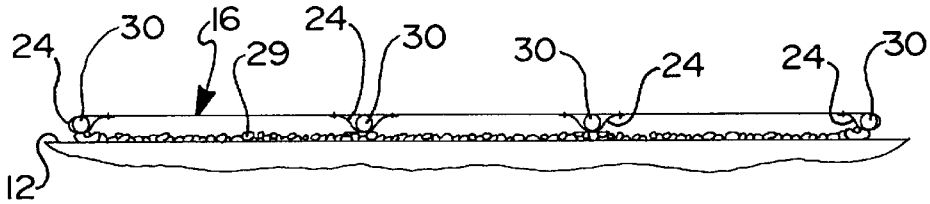
FIG. 2 is a cross-sectional view of the portable rooftop sign of FIG. 1.

As can be seen in FIG. 2, the roof 12 of the building 14 is preferably generally flat and includes a layer of gravel 29 or crushed stone. Typical roofs 12 of this type also generally have a slight pitch to provide for the drainage of water.

An elongated weight 30 inserted into each sleeve 24 secures the sheet 16 to the roof 12 without permanently damaging the roof 12 with holes for bolts or posts.

Figure 3:
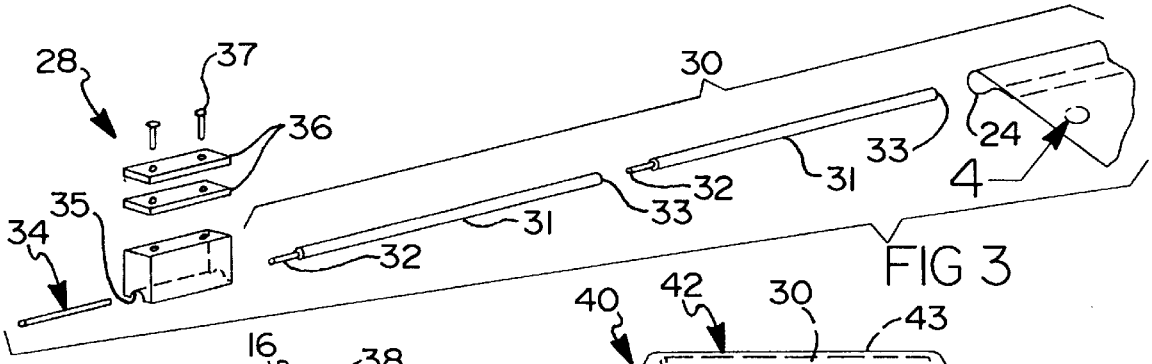
FIG. 3 is a partially exploded view of the portable rooftop sign of FIG. 1.

As can be seen in FIG. 3, each of the elongated weights 30 comprises a series of rod sections 31, each having a male threaded end 32 and a female threaded end 33. Alternatively, the rod sections 31 may be telescoped or may include snapfit or other suitable means for removably joining adjacent rod sections 31. The rod sections 31 can be aluminum or other suitable material which will provide sufficient mass to secure the sign 10. The rod sections 31 can be solid or hollow. If hollow rod section 31 are used, additional weight can be added, if necessary, by inserting short, cylindrical, solid iron billets 34 into the ends 32, 33 of the outer rod sections 31. Alternatively, sand, water, or other suitable material can be poured or blown into the ends of the rod sections 31.

In windier climates, it may be desirable to include additional end weights 28 on the protruding ends of the elongated weights 30. The end weights 28 can include an arcuate recess 35 which receives a free end of a rod section 31. Further, the end weights 28 can include metal plates 36, which are attached to the end weights 28 by screws 37 or other suitable means to provide additional mass. It should be apparent that other forms of end weights such as sand bags could also be used.

Figure 4:
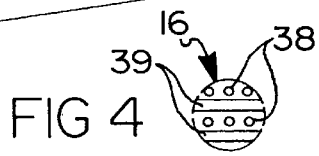
FIG. 4 is an enlarged view of the area 4 of FIG. 3.

Referring to FIG. 4, the sheet 16 preferably includes a plurality of small apertures 38 for the drainage of water. For installations in colder climates, the sign 10 can include a plurality of parallel, low-voltage, electric heating elements 39 embedded in or secured to the sheet 16 in order to melt snow from the sign.

Figure 5:
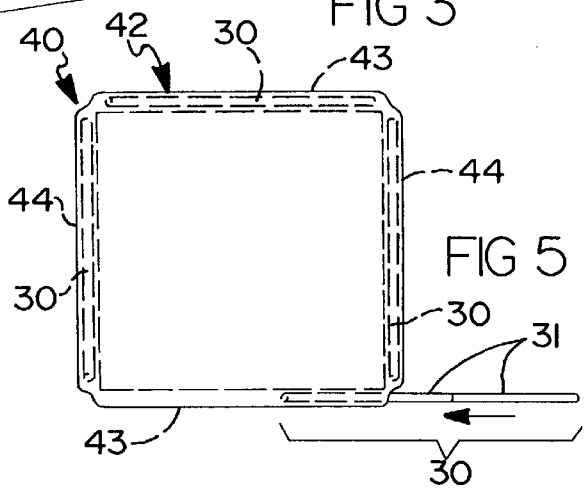
FIG. 5 is a plan view of an another embodiment of the portable rooftop sign.

In another embodiment of the present invention, shown in FIG. 5, the portable rooftop sign 40 includes a sheet 42 having a first pair of sleeves 43 and a second pair of sleeves 44, each pair formed along opposite edges of the sheet 42. The rod sections 31 are inserted into the sleeves 43, 44 and joined to form the elongated weights 30. The additional elongated weights 30 in the horizontal sleeves 43 may provide sufficient mass to eliminate the need to use any additional weights.

The portable rooftop sign 10 according to the present invention provides a lightweight sign which is visible from aircraft during landing or takeoff. The sheet 16 is provided with indicia 20 and sleeves 24 at an off-site location and transported to the roof 12 for installation. The sheet 16 is made of lightweight material and can be folded or rolled and easily transported to a building 14 which is near an airport and in or near the flight path of landing or departing airplanes. The sheet 16 is unrolled or unfolded on the roof 12 of the building 14 and the rod sections 31 are inserted one at a time into the sleeves 24. Each rod section 31 is threaded or otherwise secured to the preceding rod section 31 and then inserted into the sleeve 24. Preferably, the sign is oriented so that the elongated weights 30 are parallel to the direction of water drainage. This will further ensure that the sign 10 does not interfere with the drainage of water from the roof 12. Portable light sources 27 are preferably set up on the roof 12 and directed to illuminate the sign 10.

During display, the portable rooftop sign 10 is visible from aircraft landing or taking off from a nearby airport. At night or other times of low visibility, light sources 27 controlled by timers or photoelectric cells illuminate the sign 10. Because the sign 10 includes a plurality of apertures 38, rainwater can drain through the sheet 16 and onto the gravel roof 12. The water drains according to the natural pitch of the roof 12 through the gravel 29. In colder climates, the heating elements 39 will melt snow from the sheet 16 and allow the water to drain off of the roof 12 normally, thereby keeping the upper surface 18 clear.

When the sign 10 is eventually dismantled, the rod sections 31 can be removed by sliding out each rod section 31 from the sleeve 24 and detaching it from the adjacent rod section 31. Because the elongated weights 30 must extend across the entire sign 10, which is preferably more than 60 feet, it is necessary to form the weights 30 of a plurality of manageable rod sections 31, preferably ten feet or less. In removing the secured adjacent rod sections 31, the user can pull each rod section 31 out of the sleeves 24 one at a time and detach it from the adjacent rod section 31. After removing the elongated weights 30, the sheet 16 can be folded or rolled and removed from the roof 12. The sign 10 can be replaced with a sign having a different advertisement or can be moved to another building.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable rooftop sign for installation on a generally planar roof, comprising:

a flexible sheet having a lower surface for engaging the planar roof and an upper surface, wherein said upper surface includes indicia;

a flexible sheet sleeve provided on said flexible sheet, wherein said flexible sheet sleeve defines a sleeve channel, wherein said sleeve channel terminates in an opening;

a plurality of rod sections being disposed within said sleeve, wherein said plurality of rod sections are sized small enough relative to said sleeve channel and said sleeve channel opening such that said plurality of rod sections easily slide through said sleeve channel opening and through said sleeve channel and at least some of the plurality of rod sections include a hollow portion therein;

wherein said sign has a generally horizontal position; and wherein at least some of said rod sections contain weighted matter within said hollow portions such that said weighted matter is uniformly distributed along a respective said rod section.

2. The portable rooftop sign of claim 1, wherein at least some of the rod sections include first and second ends having male and female threads respectively.

3. The portable rooftop sign of claim 1, wherein at least some of the rod sections include means for removably joining adjacent rod sections.

4. The portable rooftop sign of claim 1, wherein said weighted matter is selected from the group of water, sand, and iron billets.

5. The portable rooftop sign of claim 1, wherein at least some of said rod sections further include external weights attached thereto.

6. The portable rooftop sign of claim 5, wherein each of said external weights include a main body having a complementary shape for engaging a respective said rod section.

7. The portable rooftop sign of claim 1, wherein said flexible sheet is fabricated from a mesh material.

8. The portable rooftop sign of claim 7, wherein said mesh material is fabricated from at least one of polyester and nylon.

9. The portable rooftop sign of claim 1, wherein said flexible sheet is coated with vinyl.

10. The portable rooftop sign of claim 1, wherein said flexible sheet includes a plurality of apertures therethrough.

11. The portable rooftop sign of claim 1, wherein said flexible sheet sleeve is included in first and second pairs of sleeves, wherein the two sleeves which comprise said first pair of sleeves are generally parallel to one another and are generally oriented at a 90° angle to the two sleeves which comprise said second pair of sleeves.

12. The portable rooftop sign of claim 1, wherein said flexible sheet sleeve is one of a plurality of parallel sheet sleeves.

13. A portable rooftop sign for installation on a generally planar roof, comrising:

a flexible sheet having a lower surface for engaging the planar roof and an upper surface, wherein said upper surface includes indicia;

a flexible sheet sleeve provided on said flexible sheet, wherein said flexible sheet sleeve defines a sleeve channel, wherein said sleeve channel terminates in an opening;

a pluralitv of rod sections being disposed within said sleeve, wherein said plurality of rod sections are sized small enough relative to said sleeve channel and said sleeve channel opening such that said plurality of rod sections easily slide through said sleeve channel opening and through said sleeve channel;

wherein said sign has a generally horizontal operating position; and wherein said flexible sheet includes heating elements attached thereto.

14. The portable rooftop sign of claim 13, wherein said heating elements are electric heating elements.

15. A method of installing a portable rooftop sign on a roof, said sign including a flexible sheet having an upper surface and a lower surface and having a sleeve defining a channel terminating in a channel opening, including the steps of:

(a) moving said sign to the roof of a building, (b) placing said lower surface of said sheet on said roof, (c) inserting a plurality of weighted members into said sleeve through said channel opening.

16. The method of claim 15, wherein step (c) further includes attaching at least two of said weighted members to one another.

* * * * *